US005363762A

United States Patent [19]

Belanger

[11] Patent Number: 5,363,762

[45] Date of Patent: Nov. 15, 1994

[54] SATELLITE PRINTING PRESS

[76] Inventor: Roger R. Belanger, 336 Back Rd., Dover, N.H. 03820

[21] Appl. No.: 36,617

[22] Filed: Mar. 24, 1993

[51] Int. Cl.[5] ..... B41F 5/16

[52] U.S. Cl. ..... 101/177; 101/218; 101/219; 101/182

[58] Field of Search ..... 101/177, 180, 181, 182, 101/217, 218, 219, 221, 144, 145, 142

[56] References Cited

U.S. PATENT DOCUMENTS

| | | | |
|---|---|---|---|
| 3,190,218 | 6/1965 | Willard | 101/145 |
| 3,593,662 | 7/1971 | Gates | 101/144 |
| 4,281,595 | 8/1981 | Fujishiro | 101/182 |
| 4,369,705 | 1/1983 | Gelinas | 101/182 |

FOREIGN PATENT DOCUMENTS

| | | |
|---|---|---|
| 0513756 | 11/1992 | European Pat. Off. . |
| 9104151 | 7/1991 | Germany . |
| 2244676A | 12/1991 | United Kingdom . |

*Primary Examiner*—Eugene H. Eickholt

[57] ABSTRACT

A printing press including at least one impression cylinder, at least one plate cylinder, a pair of swivel arms corresponding to each plate cylinder and pivotal about a central axis of the plate cylinder, and a transfer cylinder corresponding to each plate cylinder and supported by the pair of swivel arms is disclosed. The swivel arms can be pivoted, so that each transfer cylinder can be moved between a printing position where the transfer cylinder is engaged with the running web and a non-printing position where the transfer cylinder is disengaged from the running web. The transfer cylinders of the present invention also can be commonly adjusted to vary the pressure against a running web.

15 Claims, 1 Drawing Sheet

SATELLITE PRINTING PRESS

FIELD OF THE INVENTION

The invention relates generally to printing presses and particularly to satellite printing presses that allow for adjustment of the pressure against a running web or sheets and allow various cylinders of a satellite printing press to be separated.

BACKGROUND OF THE INVENTION

Prior art attempts have included the use of eccentric bushings to adjust the distance between a transfer cylinder and an impression cylinder, thereby adjusting the pressure against a running web. In U.K. Patent Application GB 2 244 676 A (and corresponding German Utility Model DE-GM 91 04 151.1) a device is described for setting the axial distance between the transfer and impression cylinder of a sheet-offset printing press having more than one printing unit arranged in series. The setting of the axial distance allows for adjustment of the pressure against a running web. The axles of the transfer cylinders are held in eccentric bushings and the distance between each transfer cylinder and its impression cylinder is set by adjusting the eccentric position of the transfer cylinder axle. Adjustment of the eccentric position of each individual transfer cylinder axle can be achieved through an individual adjusting means. The eccentric position of all the transfer cylinder axles can also be adjusted together through a common setting rod, so that the pressure applied by each transfer cylinder against its impression cylinder is adjusted by the same amount. Both the individual adjusting means and common setting rod operate to adjust the eccentric position of each transfer cylinder through a multi-sectional lever-operated gear.

A disadvantage of this solution is that no mechanism is provided for releasing the transfer cylinder from its corresponding plate cylinder.

Another disadvantage is that the lever operated gears provide a multiplicity of bearings which are expensive to manufacture and which adversely influence the accuracy of the setting.

A further disadvantage is that the eccentric removal of the transfer cylinder from the impression cylinder does not always operate as quickly as desired to stop printing to the running web.

OBJECTS AND SUMMARY OF THE INVENTION

An object of the present invention is to provide a printing press that allows for the adjustment of pressure to a running web and for the individual release of transfer cylinders from both a corresponding plate cylinders and from an impression cylinder.

Another object of the present invention is to develop a printing press which makes accurate and precise setting of the pressure to a running web possible.

The present invention provides a printing press comprising a frame, at least one impression cylinder having a shaft supported at both ends by the frame, at least one plate cylinder having a shaft defining a central axis and supported at both ends by the frame, a pair of swivel arms corresponding to each plate cylinder shaft, the pair of swivel arms supported by the frame and pivotal about the central axis of the corresponding plate cylinder shaft, a transfer cylinder corresponding to each plate cylinder and pair of swivel arms, each transfer cylinder having a shaft and capable of transferring ink from the corresponding plate cylinder to a running web on the impression cylinder, and each transfer cylinder shaft supported at one end by one of the corresponding pair of swivel arms and at the other end by the other swivel arm, the pair of swivel arms allowing for movement of the corresponding transfer cylinder between a printing position where the transfer cylinder is engaged with the running web and a non-printing position where the transfer cylinder is disengaged from the running web. The printing press further provides means for individually pivoting each pair of swivel arms, so that the corresponding transfer cylinder can be moved between the printing position and the non-printing position and means for commonly adjusting the pressure of each transfer cylinder against the running web.

The present invention also provides a method for separating a transfer cylinder of a satellite printing press from an impression cylinder and a corresponding plate cylinder, comprising the steps of (a) separating the transfer cylinder from the impression cylinder, so that the transfer cylinder is moved from a printing position to a non-printing position, and (b) eccentrically separating the transfer cylinder from the corresponding plate cylinder.

An advantage of the present invention is that the printing press can individually release a transfer cylinder from both its corresponding plate cylinder and from an impression cylinder.

Another advantage of the invention is that the printing press also provides for the setting of the pressure of the transfer cylinders against the impression cylinder.

A further advantage of the invention is that the printing press is provided with a minimal number of linkages, which allows for more accurate settings.

These and other objects and advantages of the present invention will become more apparent through the following detailed description of the embodiment and the accompanying drawings.

DETAILED DESCRIPTION

Figures 1, 2:
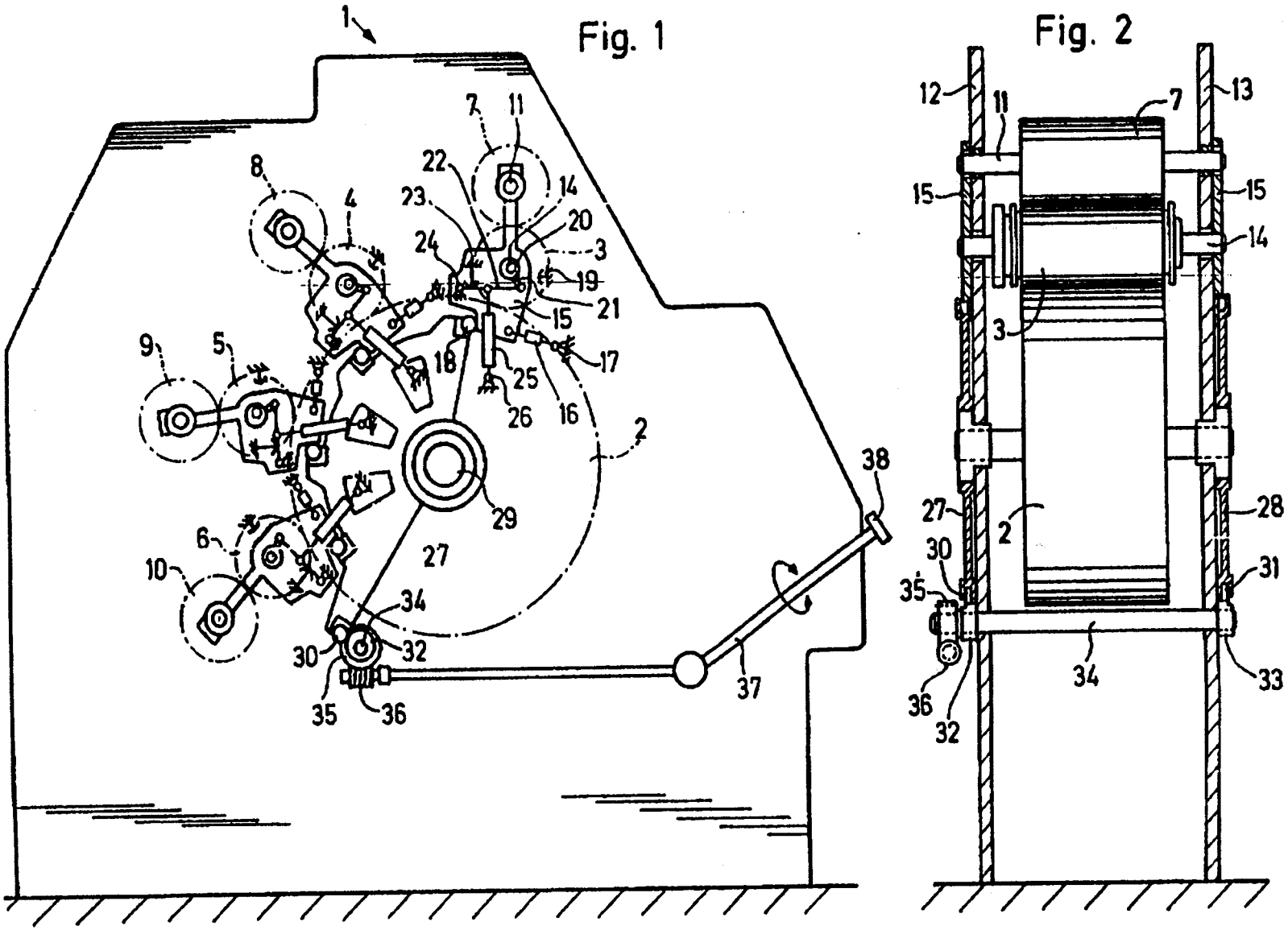
FIG. 1 is a diagram of the device within a satellite printing press.
FIG. 2 is a cross-sectional view of part of the device according to FIG. 1.

The present invention is shown in FIGS. 1 and 2. FIG. 1 shows a satellite printing press 1, in which four transfer cylinders 3, 4, 5, 6 and plate cylinders 7, 8, 9, 10 are assigned in pairs to an impression cylinder 2. The details of the present invention are shown particularly with reference to the first transfer cylinder-plate cylinder pair comprising transfer cylinder 3 and plate cylinder 7. It will be understood that each transfer cylinder-plate cylinder pair can function similarly to this first pair.

As shown in FIG. 2, a shaft 11 of the plate cylinder 7 is rigidly held in a frame comprising side wall 12 and side wall 13 of the satellite printing press 1. Swivel arms 15, 15' are provided outside of side walls 12, 13, respectively, and can pivot about shaft 11. A shaft 14 of the transfer cylinder 3 is held eccentrically in swivel arms 15, 15'. For purposes of illustration, the present invention will be described with reference to swivel arm 15, as shown in FIG. 1. However, it will be understood that swivel arm 15' operates in the same manner as swivel arm 15 through matching actuation means.

Swivel arm 15 is coupled to a pneumatic cylinder 16 that is rotatably fastened by a pin 17 in the side wall 12. The motion of swivel arm 15 as it pivots about shaft 11 is limited in the clockwise direction by an eccentric bolt 18 and in the counter-clockwise direction by a stop 19.

Shaft 14, which is supported on one side by the swivel arm 15 and on the other side by swivel arm 15', has an eccentric bearing on each side, the eccentric bearing 20 being located on the side supported by swivel arm 15. Eccentric bearing 20 is coupled to a link 21. Link 21 is also coupled to one end of an elbow lever 22. The other end of elbow lever 22 is attached rotatably to swivel arm 15 through a pin 24. Elbow lever 22 is free to bend around an articulated point 22'. However, the movement of elbow lever 22 is limited in one direction by a stop 23. An additional pneumatic cylinder 25 is rotatably coupled at one end to the articulated point 22' of the elbow lever drive 22 and on the other end to a pin 26 in the side wall 12.

The present invention further provides for eccentric bolts on both sides of the impression cylinder 2 that are mounted on two segmentally shaped disks 27, 28, the eccentric bolt 18 being mounted on disk 27. The eccentric bolts can be individually rotated to vary their eccentric position. The two discs 27, 28 are rotatably held on a shaft 29 of the impression cylinder 2. The two discs 27, 28 each have at their lower end cam followers 30, 31, respectively. Cam followers 30, 31 are adjacent against cam disks 32, 33, respectively, which are mounted on a shaft 34. The center of gravity of the disks 27, 28 is positioned in such a way, that the disks put pressure, through cam followers 30, 31, on the cam discs 32, 33. A worm gear 35 is fastened on the shaft 34, which is in engaged with a worm 36. The worm 36 is coupled with a bent setting shaft 37, which is guided to the outside. An actuating element 38 is attached to the setting shaft 37, so that an operator can twist the setting shaft 37 with the actuating element 38.

The operation of the device is described as follows:

FIG. 1 shows the satellite printing press with all four transfer cylinders 3, 4, 5, 6 in a printing position, where the transfer cylinders 3, 4, 5, 6 are in contact with the corresponding plate cylinders 7, 8, 9, 10 and a running web (not shown) on the impression cylinder 2. The operation of the separation of a transfer cylinder from its corresponding plate cylinder and from the impression cylinder 2 will be described with respect to the first pair of transfer cylinder 3—plate cylinder 7. However, it should be understood that each transfer cylinder—plate cylinder pair can operate independently of every other pair.

In order to separate transfer cylinder 3 from the running web on the impression cylinder 2 and from plate cylinder 7, pneumatic cylinders 16 and 25 are actuated one after the other. Pneumatic cylinder 16 first pulls the swivel arm 15 so that it rotates about shaft 11 to be adjacent to the stop 19. This rotation lifts the transfer cylinder 3 away from the impression cylinder 2, thereby moving the transfer cylinder 3 from the printing position to a non-printing position. The pneumatic cylinder 25 then pulls the elbow lever drive 22 at articulated point 22' from the stop 23. The elbow lever 22 bends at articulated point 22' to form a V-shape, and with this motion moves link 21 clockwise. The clockwise movement of link 21 rotates the eccentric bearing 20 so that the transfer cylinder 3 is released from the plate cylinder 7. It should be understood that swivel arm 15' operates simultaneously and identically to swivel arm 15 through a matching actuation mechanism on the other side of the satellite printing press.

The transfer cylinder 3 is now separated from both plate cylinder 7 and the running web on impression cylinder 2. In order to reposition transfer cylinder 3 against the impression cylinder 2 and the plate cylinders 7, the pneumatic cylinders 16 and 25 are actuated in reversed sequence. First, pneumatic cylinder 25 pushes the elbow lever 22 adjacent to the stop 23, which rotates the eccentric bearing 20 and brings the transfer cylinder 3 into contact with plate cylinder 7. Then, the pneumatic cylinder 16 pushes the lower portion of the swivel arm 15 against the corresponding eccentric bolt 18, which is arranged on the disk 27. When the swivel arms 15, 15' are against the eccentric bolts, the transfer cylinder 3 is in the printing position.

All of the swivel arms of the transfer cylinders 3, 4, 5, 6 in the printing position are pushed against the eccentric bolts on the discs 27, 28 by the pneumatic cylinders, including pneumatic cylinder 16. The discs 27, 28 therefore provide a common control for the pressure of the transfer cylinders in printing position to the running web, as will be described herein. When the discs 27, 28 are moved counterclockwise about the impression cylinder shaft 29, the swivel arms of the transfer cylinders in printing position move clockwise about the corresponding plate cylinder shaft, because pneumatic cylinders, including pneumatic cylinder 16, push the swivel arms in that direction. As the swivel arms move clockwise, the distance between the transfer cylinders and the impression cylinder 2 decreases, increasing pressure to the web running between the transfer cylinders and the impression cylinder 2.

To decrease the pressure to the running web, the discs 27, 28 are moved clockwise around the impression cylinder shaft 29. This clockwise motion moves the swivel arms of the transfer cylinders counterclockwise about the corresponding plate cylinder shafts, and moves the transfer cylinders slightly away from the impression cylinder 2. As the distance between the transfer cylinders and the impression cylinder 2 increases, pressure to the running web is decreased.

The rotation of disks 27, 28 is controlled by an operator with the aid of a gearing arrangement as follows. Disc 27 has a cam follower 30 on its lower end, and disc 28 has a cam follower 31 on its lower end, as shown in FIG. 2. A cam shaft 34 is provided with cams 32, 33 that engage cam followers 30, 31, respectively. The rotation of the cam shaft 34 rotates the cams 32, 33, thereby rotating the discs 27, 28 through the cam followers 30, 31, respectively. The cam shaft 34 is also provided with a worm gear 35. A worm 36 on a setting shaft 37 engages the worm gear 35, thereby allowing rotation of the setting shaft 37 to effect rotation of the cam shaft 34. The setting shaft 37 has an actuating element 38 to allow an operator to rotate the setting shaft 37. Through this gearing arrangement, the operator can vary the position of the discs 27, 28 and thereby set the pressure of the transfer cylinders 3, 4, 5, 6 in printing position to the thickness of the web or sheet to be printed. This adjustment can be made while the machine is running. It is also contemplated that the gearing arrangement could be provided with a motor to assist the operator in making adjustments.

It should be noted that it is desirable to have each transfer cylinder 3, 4, 5, 6 provide identical pressure to the running web. This allows for uniform print quality. To provide identical pressure by each transfer cylinder to the running web, the printing press is constructed so that the distance between each transfer cylinder in the printing position and the impression cylinder is the same, irrespective of the position of disks 27, 28. However, variances may occur due to imperfect manufacturing, construction or other reasons. The present invention therefore provides for individual adjustment of the printing position distance between the individual transfer cylinders 3, 4, 5, 6 and the impression cylinder 2. As noted above, when the transfer cylinders 3, 4, 5, 6 are in the printing position, the corresponding swivel arms are against the eccentric bolts, including eccentric bolt 18, of the discs 27, 28. While the rotation of the discs 27, 28 provides a common pressure control, individual control is also provided by the individual eccentric bolts, including eccentric bolt 18. Because each eccentric bolt can be individually rotated to vary the eccentric position of the eccentric bolt, the distance that the corresponding swivel arm can travel can be adjusted, thereby altering the distance between the corresponding transfer cylinder and the impression cylinder 2 when in the printing position. The pressure of each transfer cylinder 3 against the running web therefore can be adjusted individually to allow for uniform printing quality.

While the preferred embodiment has been disclosed with reference to a plurality of transfer cylinders, it is understood that the present invention could be used with a single transfer cylinder. It is also contemplated that the present invention could be provided in an in-line printing press with more than one impression cylinder. It is also understood that many varying and different embodiments could fall within the scope of the present invention disclosed herein.

I claim:

1. A printing press, comprising:

a frame;

at least one impression cylinder having a shaft supported at both ends by the frame;

at least one plate cylinder having a shaft defining a central axis and supported at both ends by the frame;

a pair of swivel arms corresponding to each plate cylinder shaft, the pair of swivel arms supported by the frame and pivotal about the central axis of the corresponding plate cylinder shaft;

a transfer cylinder corresponding to each plate cylinder and pair of swivel arms, each transfer cylinder having a shaft and capable of transferring ink from the corresponding plate cylinder to a running web on the impression cylinder; and each transfer cylinder shaft supported at one end by one of the corresponding pair of swivel arms and at the other end by the other swivel arm, the pair of swivel arms allowing for movement of the corresponding transfer cylinder between a printing position where the transfer cylinder is engaged with the running web and a non-printing position where the transfer cylinder is disengaged from the running web.

2. The printing press as recited in claim 1, wherein:

each pair of swivel arms is pivotally connected to the frame by the corresponding plate cylinder shaft, one swivel arm pivotally disposed on one end of the corresponding plate cylinder shaft and the other swivel arm pivotally disposed on the other end.

3. The printing press as recited in claim 1, further comprising:

means for individually pivoting each pair of swivel arms, so that the corresponding transfer cylinder can be moved between the printing position and the non-printing position.

4. The printing press as recited in claim 3, in which the individual pivoting means comprises:

a pneumatic cylinder corresponding to each swivel arm, each pneumatic cylinder connected at one end to the corresponding swivel arm and at the other end to the frame.

5. The printing press as recited in claim 3, wherein:

each transfer cylinder shaft has eccentric bearings at both ends, so that the transfer shaft is eccentrically supported through one eccentric bearing by one of the corresponding pair of swivel arms and is eccentrically supported through the other eccentric bearing by the other swivel arm.

6. The printing press as recited in claim 5, further comprising:

means for varying the eccentric position of each transfer cylinder shaft when the transfer cylinder is in the non-printing position, so that each transfer cylinder can be moved between a first eccentric position in which the transfer cylinder is engaged with the corresponding plate cylinder and a second eccentric position in which the transfer cylinder is disengaged with the corresponding plate cylinder.

7. The printing press as recited in claim 6, in which the eccentric varying means comprises:

a link attached to each eccentric bearing of each transfer cylinder shaft;

an elbow lever corresponding to each link, each elbow lever attached at one end to the corresponding link and at the other end to the corresponding swivel arm, each elbow lever having an articulated point; and a pneumatic cylinder corresponding to each elbow lever, the pneumatic cylinder attached at one end to the articulated point of the corresponding elbow lever and at the other end to the frame.

8. The printing press as recited in claim 7, wherein:

the elbow lever is straight when the corresponding transfer cylinder is in the first eccentric position, and the elbow lever is bent at the articulated point to form a V-shape when the corresponding transfer cylinder is in the second eccentric position.

9. The printing press as recited in claim 1, further comprising:

means for commonly adjusting the pressure of each transfer cylinder against the running web.

10. The printing press as recited in claim 9, wherein the common adjusting means comprises:

a pair of discs, each disc engaging one swivel arm of each pair of swivel arms when the transfer cylinder corresponding to the pair of swivel arms is in the printing position.

11. The printing press as recited in claim 10, wherein:

each disc has at least one eccentric bolt, the pair of discs engaging the swivel arms through the eccentric bolts.

12. The printing press as recited in claim 11, wherein:

each eccentric bolt is adjustable, so that the pressure of each transfer cylinder against the running web can be adjusted individually.

13. The printing press as recited in claim 10, in which the common adjusting means further comprises:

a cam shaft; and a pair of cams located on the cam shaft, each cam contacting one of the pair of discs, so that the rotation of the cam shaft rotates the pair of discs together.

14. The printing press as recited in claim 13, in which the common adjusting means further comprises:

a worm gear mounted on the cam shaft;

a worm for engaging the worm gear; and a setting shaft connected to the worm.

15. The printing press as recited in claim 14, in which the common adjusting means further comprises:

an actuating element connected to the setting shaft and operable to turn the setting shaft.

* * * * *